United States Patent [19]
Fekete et al.
[11] 3,995,682
[45] Dec. 7, 1976

[54] CONTINUOUS CASTING APPARATUS WITH POUR TUBE HAVING LATERAL SLOT-LIKE OPENINGS

[75] Inventors: Kàlmàn Fekete, Stafa; Walter Meier, Winterthur; Ferdinand Fiala, Thalwil, all of Switzerland

[73] Assignee: Concast AG, Zurich, Switzerland

[22] Filed: Apr. 26, 1974

[21] Appl. No.: 464,698

[30] Foreign Application Priority Data

May 7, 1973 Switzerland ..... 6417/73

[52] U.S. Cl. ..... 164/281 R; 222/591
[51] Int. Cl.[2] ..... B22D 11/10
[58] Field of Search ..... 164/82, 281, 337, 136; 222/DIG. 1, 591

[56] References Cited

UNITED STATES PATENTS

| | | | |
|---|---|---|---|
| 2,225,414 | 12/1940 | Junghans | 164/84 |
| 2,674,019 | 4/1954 | Rossi et al. | 164/281 |
| 3,578,064 | 5/1971 | Mills et al. | 164/281 |
| 3,648,761 | 3/1972 | Speith et al. | 164/281 |
| 3,867,978 | 2/1975 | Johansson et al. | 164/82 |

FOREIGN PATENTS OR APPLICATIONS

| | | | |
|---|---|---|---|
| 843,137 | 7/1952 | Germany | 164/281 |
| 221,233 | 9/1968 | U.S.S.R. | 164/281 |

*Primary Examiner*—Robert D. Baldwin
*Attorney, Agent, or Firm*—Werner W. Kleeman

[57] ABSTRACT

An apparatus for use during continuous casting for the introduction of a metallic, typically steel melt into the casting head of a continuous casting mold, comprising a substantially tubular-shaped portion which directly merges with a pouring or casting vessel, the cross-sectional area of the tubular-shaped portion being greater than the cross-sectional area of the pouring outlet at the casting vessel. A chamber-like portion of larger cross-sectional area merges with the tubular-shaped portion. The chamber-like portion is equipped with a multiplicity of neighboring openings, the individual cross-sectional area of which is considerably smaller than the cross-sectional area of the tubular-shaped portion.

3 Claims, 4 Drawing Figures

CONTINUOUS CASTING APPARATUS WITH POUR TUBE HAVING LATERAL SLOT-LIKE OPENINGS

BACKGROUND OF THE INVENTION

The present invention relates to a new and improved construction of apparatus for use during continuous casting for the introduction of a liquid melt, typically a steel melt, into the casting head of a mold, which apparatus comprises a tubular-shaped portion which directly connects with a casting or pouring vessel, the cross-sectional area of the tubular-shaped portion being greater than the cross-sectional area of the pouring outlet provided at the casting vessel, and there is further provided a chamber-like portion of greater cross-sectional area which merges with the tubular-shaped portion.

There is known in this particular field of technology a tubular infeed or delivery device which possesses a vessel-like widened portion at the side of the tubular portion which confronts the mold, this widened portion possessing one or a number of outlet openings, the cross-section of which is considerably smaller than the cross-section of the tubular portion. However, this prior art piece of equipment is only intended to solve the problem concerning the formation of turbulencce through nozzle-like outlet openings. The tubular portion or tube is accommodated to the cross-section of the casting jet.

Furthermore, apparatus is known in this art wherein for the purpose of distributing a melt, a chamber merges with a tubular-shaped portion which is mounted at a tundish. This chamber immerses into the liquid melt in the mold and possesses outlet openings having cross-sections which are larger than the cross-section of the tubular-shaped portion. The purpose of this piece of equipment is to reduce the number and size of the disturbing contaminants at the casting by virtue of a reduction in the penetration depth of the casting jet.

These devices, which have become known in this particular art under the terminology casting boxes, are however associated with a decisive drawback. Due to the size and construction of the outlet openings, there prevails an unstable flow at the outflowing steel. This causes an uncontrolled, non-symmetrical efflux or discharge, so that the growth of the strand shell or skin at the narrow sides is differently affected or in fact there can be ascertained erosion effects. Further, there is impaired the effectiveness of the separation of contaminants.

SUMMARY OF THE INVENTION

Hence, it is a primary object of the present invention to overcome the aforementioned drawbacks of the heretofore known casting boxes.

Another and more specific object of the present invention aims at the provision of a new and improved construction of apparatus for the introduction of a liquid melt into the casting head of a mold during continuous casting in a manner avoiding or at least minimizing unstable flow and thus insuring for a uniform, extensively undisturbed growth of the shell at the cast strand.

A further object of the invention aims at improving the separation of contaminants and thus the quality of the cast product by suitably controlling i.e. forming the flow of the cast metal.

Now in order to implement these and still further objects of the invention, which will become more readily apparent as the description proceeds, the apparatus for the introduction of a steel melt or the like into the casting head of a continuous casting mold as contemplated by this development is manifested by the features that the chamber-shaped portion is equipped with a multiplicity of neighboring openings, the individual cross-sections or cross-sectional areas of which are in each instance considerably smaller than the cross-section or cross-sectional area of the tubular-shaped portion. In the context of this disclosure, the expression "multiplicity of neighboring openings", or equivalent terminology, is intended to mean that at least two openings are directed towards one side of the mold and/or downwardly. Due to this construction, there is formed a sieve-like perforation of the wall of the chamber-shaped portion, resulting in a stable, uniform flow, especially towards the sides. By eliminating the instability of the flow, the shell or skin of the cast strand can uniformly grow at both sides and there is decisively prevented the danger of casting disturbances brought about by irregular growth of the skin or shell, for instance erosions and their consequences.

The openings can be designed so as to be round, oval or slot-shaped, and advantageously the diameter thereof can be typically, for instance, in the order of between 5 and 30 mm. and the inner width of the slots in the order of between 4 and 20 mm. Also an oval construction of the openings is possible.

It is advantageous if the slot-like openings in the chamber-shaped or compartment-shaped portion are located one below the other, in other words in superimposed fashion, and the wide sides of the openings in the wall serve as guide surfaces for the outflowing steel or metallic melt.

In order to impart to the steel jet a directed flow component, such guide surfaces can be in the form of at least one slot-like opening inclined with regard to the horizontal.

According to a further advantageous manifestation of the invention, the guide surfaces of the uppermost and lowermost slots are inclined away from one another i.e. diverge. As a result, the fan-like shaped outflowing steel currents or jets flow apart i.e. away from one another while destroying kinetic energy. Consequently, the growth of the strand shell which is located in the flow direction remains extensively undisturbed.

In order to render possible a replacement or exchange of the markedly loaded chamber-like portion, such is advantageously detachably secured to the tubular-shaped portion. This can be accomplished in a number of different ways, for instance by threading, supports or holder members and the like.

It can be advantageous to construct the chamber-like portion so as to be elevationally adjustable in order to influence the formation of the flow at the casting head. This can occur as a function of the casting speed.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
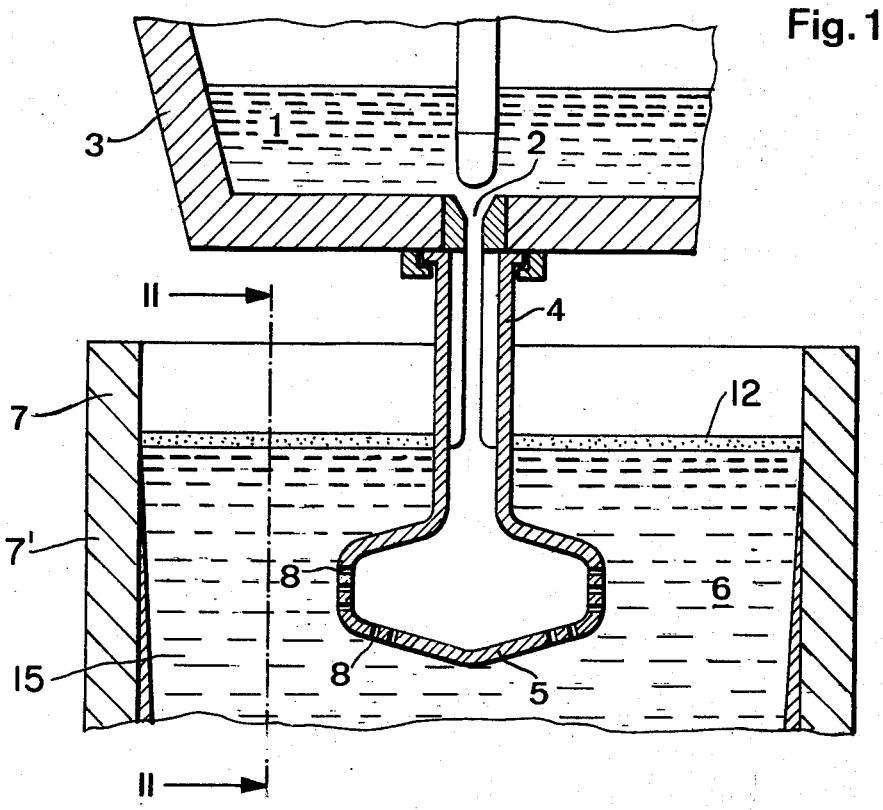
FIG. 1 is a cross-sectional view showing an exemplary embodiment of the apparatus of this invention in conjunction with a tundish and a continuous casting mold.

Describing now the drawings, it is to be understood that in the showing of FIG. 1, only enough of the continuous casting installation has been conveniently portrayed so as to enable those skilled in the art to fully appreciate the underlying concepts of the development of this invention. Hence, by referring to FIG. 1 it will be recognized that a liquid metal or melt, typically steel, as generally indicated by reference character 1, flows through the outlet or pouring opening 2 of a suitable casting or pouring vessel, here shown as a tundish 3, and then initially through a substantially tubular member or tube 4 which is directly connected to and merges with such casting or pouring vessel. Merging with the tubular-shaped portion or tube 4 is a compartment- or chamber-shaped portion 5 which introduces the inflowing steel into the casting head 6, i.e. liquid metal pool, contained within a continuous casting mold 7, for instance a slab mold bounded by side walls 7' defining the mold cavity or compartment 15. In so doing, the steel flows through a multiplicity of neighboring openings or holes 8. In the exemplary embodiment under discussion, there are provided openings 8 which are directed both towards the sides of the mold 7 as well as also downwardly, as best seen by referring to FIG. 1. The number of openings, with a given throughflow cross-section, is primarily dependent upon the quantity of steel which is to be introduced. The tubular member or tube 4 possesses a larger cross-sectional area than the outlet opening 2 at the tundish 3; the cross-section or cross-sectional area of the individual openings 8 in the chamber-shaped portion 5 is, however, considerably smaller than the cross-section of the tubular member 4.

Figure 2:
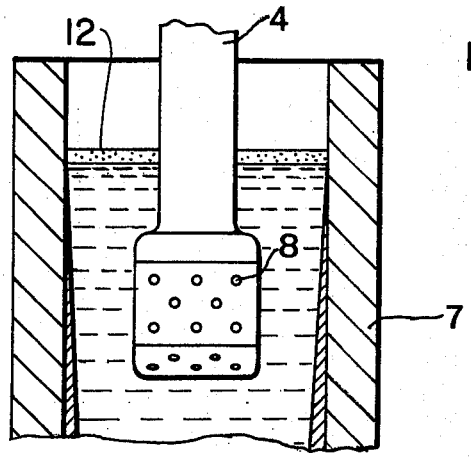
FIG. 2 is a cross-sectional view of the arrangement depicted in FIG. 1, taken substantially along the line II—II thereof.

Fig. 2 clearly illustrates the multiplicity of holes or openings 8 which are arranged adjacent and below one another in different substantially horizontal planes at the sieve-like constructed portion 5 of the pouring or casting device. It has been found that with the inventive apparatus there can be realized a stable flow and a uniform distribution of the quantity of metal, especially in the direction of both narrow sides of the slab mold 7.

Figure 3:
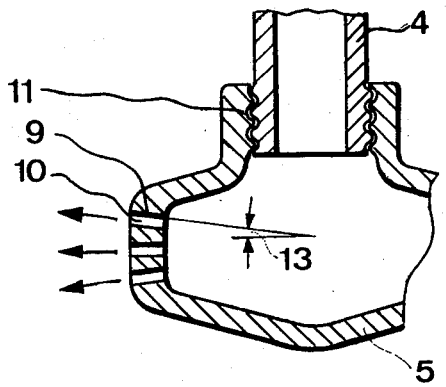
FIG. 3 is a fragmentary cross-sectional view of a further embodiment of apparatus for the introduction of a metallic melt into the casting head of a continuous casting mold.
Figure 4:
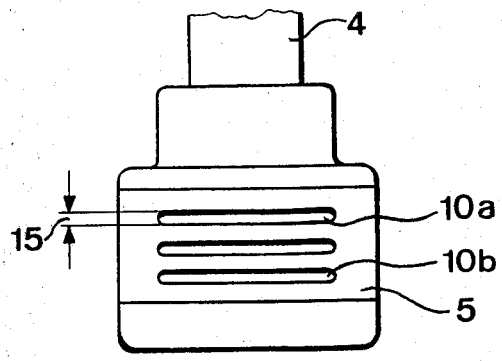
FIG. 4 is a fragmentary side view of the apparatus depicted in FIG. 3.

FIG. 3 illustrates a modification of the invention wherein instead of the holes or openings 8 there can be provided slots 10 which introduce the steel in a substantially fan-shaped pattern into the casting head. In this embodiment the slots 10 are arranged beneath one another again in different substantially horizontal planes. The wide sides 9 of the slots 10 function as guide surfaces for the outflowing steel. By virtue of their inclination with respect to the horizontal, as indicated by the angle 13 which for instance may be in the order of 5° to 20°, it is possible to impart to the steel a desired outflow direction. Due to a desired divergence or flowing apart of the emanating jets of metal, it is possible to reduce their kinetic energy, so that there is realized a further reduction in the danger or erosion. Due to the fan-like widening effect there is insured for a quieter metallic bath with as slight as possible aqitation of the slag cover or blanket 12. As the exemplary embodiment under discussion shows, the chamber-like portion 5 can be detachably secured by threading 11 or equivalent means at the tube or tubular member 4, allowing such components to be exchanged and also selectively elevationally adjusted. Of course, such threading or equivalent fastening and/or adjustment means can be equally provided for the arrangement shown in FIGS. 1 and 2.

With regard to the diameter of the openings and the inner width of the slots, there are certain limits. If such are too small, then clogging can arise. Advantageously, and purely by way of example, the diameter of the openings 8 is typically in the order of between 5 and 30 mm., the inner width 15 of the slots 10 between 4 and 20mm and the slot length between 50 mm. and 150 mm. Further, the inner diameter of the tube 4 is typically in the order of 5 centimeters and 10 centimeters, by way of example.

Of course, within the concepts of the invention it is possible to also use oval or other configured slots, provided that they fulfill the indicated conditions and functions. Finally, it is to be understood that in the context of this disclosure the statement that the holes or slots or the like are located in different substantially horizontal planes embraces all of the embodiments disclosed herein, even when the slots are somewhat inclined as previously explained.

While there is shown and described present preferred embodiments of the invention, it is to be distinctly understood that the invention is not limited thereto, but may be otherwise variously embodied and practiced within the scope of the following claims.

Accordingly, what is claimed is:

1. An apparatus for use during continuous casting for the introduction of a metal melt, especially a steel melt, into the casting head of a continuous casting mold having side walls, comprising a casting vessel equipped with an outlet, a substantially tubular-shaped portion directly merging with said casting vessel, said tubular-shaped portion having a cross-sectional area which is greater than the cross-sectional area of the outlet of the casting vessel, a substantially chamber-shaped portion of substantially larger cross-sectional area than the cross-sectional area of the tubular-shaped portion merging with said tubular-shaped portion, said chamber-shaped portion being equipped with a multiplicity of neighboring openings arranged at different substantially horizontal planes, said multiplicity of neighboring openings being arranged at the chamber-shaped portion such that the metal streams flowing out of the openings flow in the direction of predetermined side walls of the mold and without the metal streams flowing out at each of said multiplicity of openings appreciably colliding with one another, the individual cross-sectional area of each opening being considerably smaller than the cross-sectional area or the tubular-shaped portion, said openings being of substantially laterally extending slot-like construction and having an internal width in the order of between 4 and 20 mm, said slot-like openings being located beneath one another in vertical direction and having wide sides which serve as guide surfaces for the outflowing metal, said guide surfaces of at least one slot-like opening being inclined at an angle with respect to the horizontal, and said slot-like openings including an uppermost slot-like opening and a lowermost slot-like opening, at least the guide surfaces of the uppermost and lowermost slot-like openings being directed away from one another in the outflow direction.

2. The apparatus as defined in claim 1, further including means for detachably securing the chamber-shaped portion at the tubular-shaped portion.

3. The apparatus as defined in claim 1, further including means for elevationally adjusting the chamber-shaped portion.

* * * * *